US005886613A

United States Patent [19]

Magoon et al.

[11] Patent Number: 5,886,613

[45] Date of Patent: Mar. 23, 1999

[54] INDICATING FUSE WITH PROTECTIVE SHIELD

[75] Inventors: Donald Joseph Magoon; Keith Alan Overton, both of Goldsboro, N.C.; Ronald Emil Mollet, Ellisville, Mo.

[73] Assignee: Cooper Technologies Company, Houston, Tex.

[21] Appl. No.: 97,718

[22] Filed: Jun. 16, 1998

[51] Int. Cl.[6] ..... H01H 85/30

[52] U.S. Cl. ..... 337/244; 337/265; 337/267; 337/241

[58] Field of Search ..... 337/241, 244, 337/142, 144, 148, 150, 154, 155, 206, 161, 162, 265, 267

[56] References Cited

U.S. PATENT DOCUMENTS

| | | | |
|---|---|---|---|
| 1,954,037 | 4/1934 | Bowie . | |
| 2,497,257 | 2/1950 | Chase . | |
| 3,281,557 | 10/1966 | Fister . | |
| 3,636,491 | 1/1972 | Cameron | 337/244 |
| 3,663,915 | 5/1972 | Kozacka | 337/244 |
| 3,678,430 | 7/1972 | Gaia | 337/159 |
| 3,764,949 | 10/1973 | Swain | 337/244 |
| 4,023,133 | 5/1977 | Knapp, Jr. . | |
| 4,204,182 | 5/1980 | Knapp, Jr. | 337/244 |
| 4,323,874 | 4/1982 | Link . | |
| 4,387,358 | 6/1983 | Knapp, Jr. | 337/244 |
| 4,695,815 | 9/1987 | Hwang . | |
| 5,023,588 | 6/1991 | Heitzig et al. . | |
| 5,055,818 | 10/1991 | Bueschel . | |
| 5,481,239 | 1/1996 | Di Troia . | |
| 5,594,404 | 1/1997 | Happ et al. . | |

*Primary Examiner*—Leo P. Picard
*Assistant Examiner*—Anatoly Vortman
*Attorney, Agent, or Firm*—Burns, Doane, Swecker & Mathis, L.L.P.

[57] ABSTRACT

A pin indicating fuse construction incorporates a protective shield member that isolates an indicator assembly from a main-fuse link. By use of the inventive protective shield, arc-quenching filler may be excluded, resulting in a less-costly, more reliable fuse construction. The main fuse link is arranged within the fuse in such a manner so as to minimize potential interference with the actuator assembly during activation of the indicator assembly.

21 Claims, 4 Drawing Sheets

INDICATING FUSE WITH PROTECTIVE SHIELD

BACKGROUND OF THE INVENTION

1. Field of the Invention

This invention relates to fuses generally, and in particular it relates to fuses incorporating an indicating device.

2. Related Art

Fuses incorporating indicating devices are generally known in the art. An existing indicating fuse design 100 is illustrated in FIG. 3A. A fuse body 116 optionally includes an orientation ring 114 that may be disposed on the periphery of the fuse body 116. The orientation ring 114 serves to insure proper installation of the fuse 100. The precise structure and function of such an orientation device is described in U.S. Pat. No. 5,549,404, the disclosure of which is incorporated herein by reference.

Terminals 118 and 120 are disposed at opposite ends of the fuse. A main fuse element or link 122 is electrically connected to each of the terminals 118, 120. The majority of current passing through the fuse 100 is carried by the main fuse element 122 during normal operating conditions. "Normal operating conditions", or the normal operative state of the fuse is intended to mean a condition wherein the main fuse element 122 is intact, and current can pass from one terminal (118 or 120), through the fuse 100 without substantial interruption, and out of the fuse through the opposite terminal (118 or 120).

A conductor wire 142 is connected at one end to one terminal 118, and to an end of an indicator assembly 144. The indicator assembly includes an indicator pin 146, having a flat or "planished" end 148, a biasing member sleeve 156, and a biasing member 158 that contacts the bottom of the sleeve 156 and the head of the indicator pin 146 thereby tending to urge the indicator pin outward. The conductor wire 142 is attached to the planished end 148 of the indicator pin 146 thereby preventing the indicator pin 146 from being urged outwardly from the fuse by bias member 158 during normal operating conditions.

The fuse 100 normally includes a granular arc-quenching medium 150 in order to suppress and contain arcing during destruction of the main fuse link when the fuse 100 is "blown". The arc-quenching medium is typically a fine granular substance such as sand, terra alba, or mixtures thereof.

In certain lower amperage rated ruses, conductive wire 142 also serves as the main fuse link, thereby enabling omission of a separate main fuse link element 122 from the fuse 100 construction.

During normal operating conditions current is carried through the fuse primarily via main fuse link 122. In the event that the main fuse link 122 is destroyed (e.g., during an overload condition), current is diverted to the conductor wire 142. The capacity of conductor wire 142 to carry current is substantially less than that of main fuse link 122. Therefore, upon the above-mentioned diversion of current, conductor wire 142 is quickly destroyed. The conductor wire 142 is no longer capable of restraining the indicator pin 146, so bias member 158 urges the pin 146 outward from the fuse body 116 thereby indicating a blown fuse condition 112.

Various problems are associated with existing fuse constructions.

Historically, pin-indicator fuses generally require an arc-quenching filler in order to provide adequate performance for fuses rated at approximately 5 Amps or greater. This is particularly true for fuses having a current rating in excess of 15 Amps. However, inclusion of such a filler adds to the manufacturing costs of the fuse. Clearly, the filler adds to the materials cost of the fuse. Also, granular fillers are very destructive to the manufacturing equipment that is used to store, transport, and introduce the filler into the fuse. The filler also tends to adversely impact operation of the fuse indicator assembly by fouling the spring biasing element and otherwise inhibiting proper movement of the indicator assembly components. Moreover, the heat and electrical arcing associated with destruction of the fuse link can cause a reaction with the filler and produce aggregates or globules of filler which further act to prevent proper activation of the indicator assembly and movement of the indicator pin.

Another problem associated with existing designs is that the main fuse link may be deformed when the fuse is "blown" so that it comes into contact with the indicator pin thereby preventing the indicator pin from being pushed outwardly away from the fuse body to clearly indicate the fuse has been "blown".

A related problem is that the main fuse link can at least partially melt upon destruction and become affixed or welded to the conductor wire thereby preventing the indicator pin from properly emerging from the fuse.

Yet another problem associated with the existing designs is that gases produced during destruction of the fuse link can escape the fuse through the hole that the indicator pin passes through.

U.S. Pat. No. 4,023,133 to Knapp, Jr. discloses an indicating fuse having a fuse body containing an arc-quenching filler. A main fuse element connects two terminals. A wire is connected to one terminal and to a pin so as to restrain the pin during normal operation. When the wire melts, or is otherwise destroyed, the pin is urged outwardly and activates a complicated indicator assembly. A cap is provided which surrounds the biased pin actuator. As noted above, the inclusion of a granular filler adds to the cost of the fuse and may adversely affect the operation of the fuse. The indicator assembly is overly complicated and expensive. Moreover, there is no disclosure relating to locating the main fuse link so as to avoid interference with the conductor wire.

U.S. Pat. No. 4,204,182 to Knapp, Jr. discloses a fuse having a body containing an arc-quenching filler. A single fuse element is connected to a terminal at one end, and to a conductor rod at the other end. A partition wall is provided which partially surrounds the conductive rod. A tubular member is also provided at an end of the fuse which partially surrounds the conductive rod. The inclusion of a granular filler adds to the cost of the fuse and may adversely affect the operation of the fuse. The filler must be contained by a partition with a relatively large opening, and by a mass of silicone grease. In addition, there is no separate conductor wire to restrain the indicator pin.

U.S. Pat. No. 3,636,491 to Cameron discloses an indicating fuse that contains an arc-quenching filler. A plurality of fuse elements connect a pair of opposing terminals. A restraining wire is attached to an indicating plunger. A housing member surrounds the indicating plunger. The restraining wire passes through a large opening in the housing member, is connected to the indicating plunger, then exits the opening and is connected to a terminal. The inclusion of a granular filler adds to the cost of the fuse and may adversely affect the operation of the fuse. The indicator assembly appears especially prone to contamination by the filler due to the large opening in the housing member. There is no disclosure of locating the main fuse element(s) so as to minimize possible interference with the conductor wire.

OBJECTS AND SUMMARY

The present invention overcomes the above mentioned problems, and others, by providing an indicating fuse construction that incorporates a protective shield member.

One preferred form of the invention includes a fuse having a fuse body and terminal portions at opposite ends of the fuse body. A main fuse link is electrically connected to each of the terminal portions. An indicator assembly is incorporated within the fuse and a conductor wire is electrically connected to one of the terminal portions and to the indicator assembly so that destruction of the electrically conductive wire activates the indicator assembly thereby indicating a blown-fuse condition. A shield member encompasses the indicator assembly. The fuse can be essentially free of filler material. In certain applications, a filler material may be used in conjunction with the shield member.

A fuse constructed according to the present invention may include a fuse body with terminal portions at opposite ends of said fuse body. An indicator assembly is incorporated within the fuse. A conductor wire is electrically connected to one of the terminal portions and to the indicator assembly, whereby destruction of the electrically conductive wire activates the indicator assembly thereby indicating a blown-fuse condition. A shield member encompasses the indicator assembly. A first end of a main fuse link is electrically connected to one of the terminal portions. The main fuse link has a first angled transition section extending from the first end that diverges away from the conductor wire in order to prevent contact and interference between the main fuse link and the conductor wire. The main fuse link has a second section extending from the angled transition area and passing between an exterior surface of the shield and an interior surface of the fuse body. The main fuse link terminates at a second end that is in contact with the other terminal.

DETAILED DESCRIPTION OF THE PREFERRED EMBODIMENTS

Figure 1:
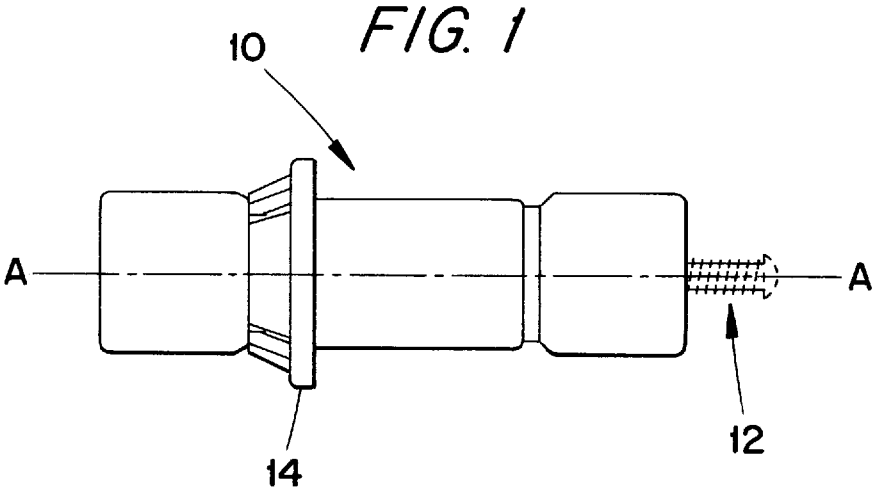
FIG. 1 is a side view of the pin indicating fuse of the present invention.
Figure 2:
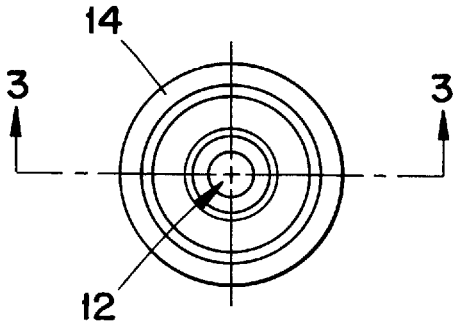
FIG. 2 is a top view of the pin indicating fuse of FIG. 1.

A fuse constructed according to the present invention 10 includes a device 12 for indicating a blown fuse condition.

The fuse 10 has an elongated body 16. While the fuse illustrated in the drawings has a cylindrically-shaped body with a longitudinal axis A, it should be evident that the fuse may be of any suitable shape (e.g., rectangular, or another polygon). The fuse body 16 is constructed of an electrically insulative material such as a glass-melamine resin material or spiral-wound vulcanized tubing.

An orientation ring 14 may be provided about the periphery of the fuse body 16. The orientation ring 14 serves to insure proper installation of the fuse 10. The precise construction and function of such an orientation device is described in U.S. Pat. No. 5,594,404, the disclosure of which is incorporated herein by reference. Alternatively, orientation ring 14 may be omitted.

Terminals 18 and 20 are provided at opposite ends of the fuse body 16. The terminals 18, 20 may be secured to the fuse body 16 by any suitable method, such as crimping. Any suitable terminal shape or construction may be employed. In a preferred form of the invention, the terminals 18, 20 are of the ferrule-type. The terminals 18, 20 are constructed of an electrically-conductive material, such as silver-plated copper, silver-nickel alloy, albaloy plated copper, copper alloy material.

Figure 3A:
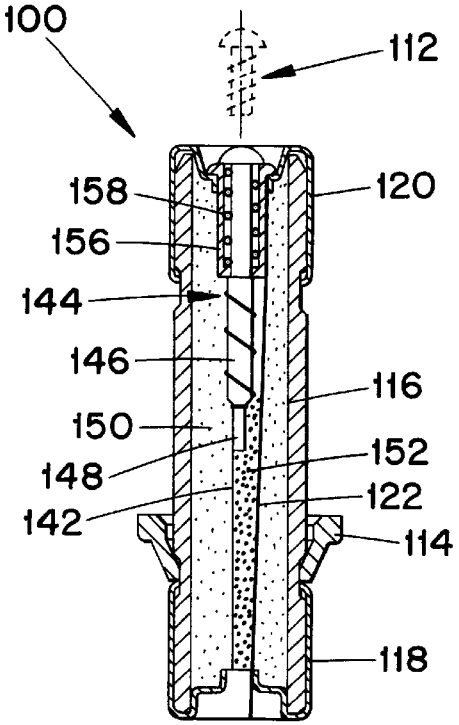
FIG. 3A is a cross-sectional view of a prior art fuse design.
Figure 3B:
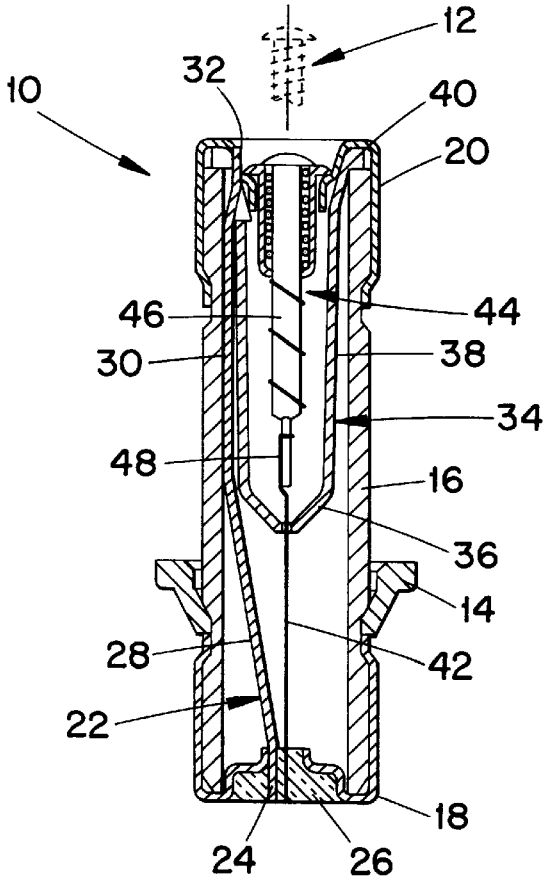
FIG. 3B is a cross-sectional view taken along lines 3—3 of FIG. 2.
Figure 4:
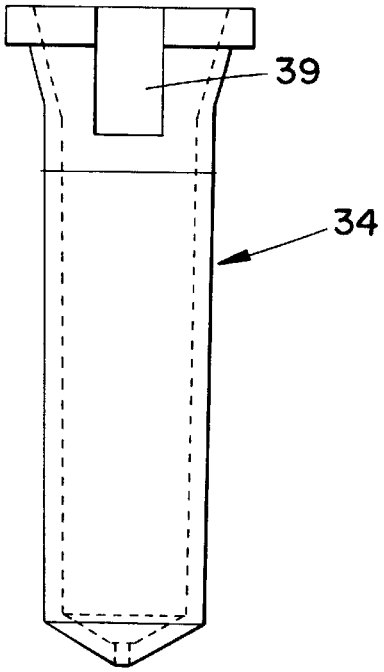
FIG. 4 is a side view of a protective shield of the present invention.
Figure 5:
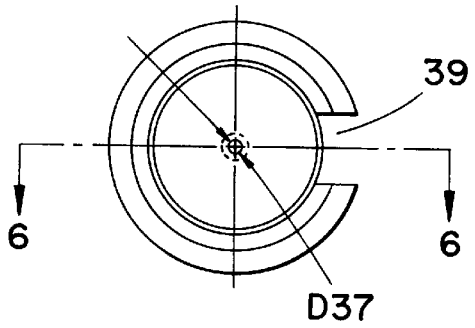
FIG. 5 is a top view of the shield of FIG. 4.
Figure 6:
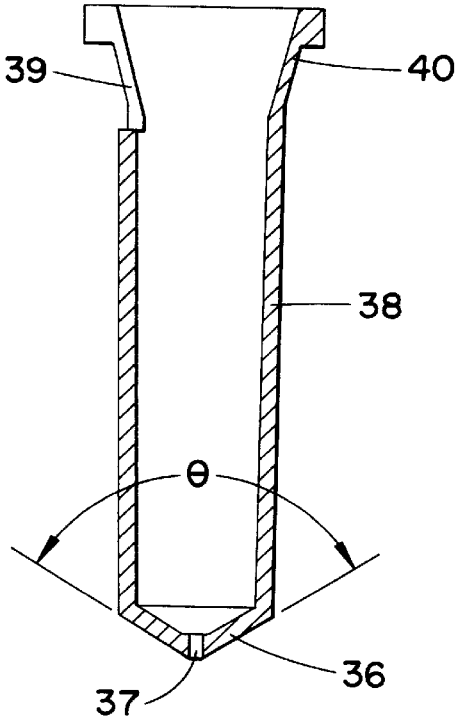
FIG. 6 is a cross-sectional view taken along line 6—6 of FIG. 5.
Figure 7:
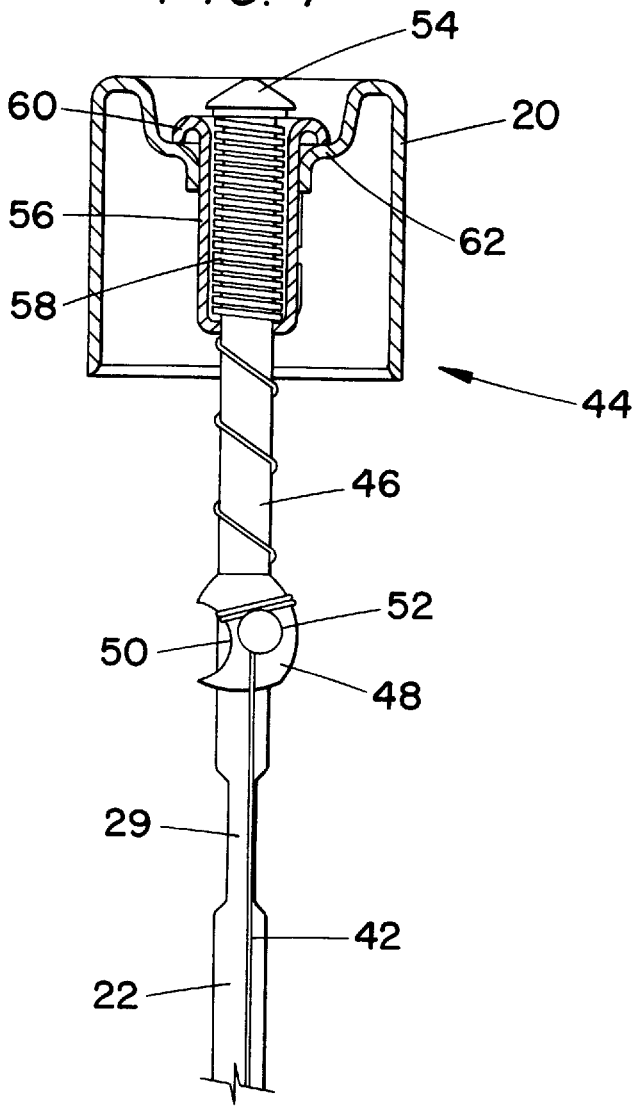
FIG. 7 is a sectional view of certain components of a fuse constructed according to the present invention.

An indicator assembly 44 is disposed substantially within the fuse body 16. The indicator assembly is best illustrated in FIGS. 3B and 7. The indicator assembly includes an indicator pin 46. One end of the indicator pin 46 is in the form of an enlarged flat or "planished" formation 48 having an arcuate groove 50 formed therein. An enlarged head 54 is provided at the opposite end of the pin 46. The enlarged head portion 54 of the indicator pin 46 may be brightly colored, or provided with other means to improve its visibility.

A bias member sleeve 56 surrounds at least a portion of the indicator pin 46. The bias member sleeve 56 has a mounting flange 60 that rests upon a mounting ledge 62 provided on the terminal 20. The mounting ledge 62 defines a central aperture which receives the bias member sleeve 56. The bias member sleeve may be received with an interference fit in the central aperture. The bias member sleeve 56 may be affixed to the ferrule by any suitable means, such as the above-mentioned interference fit, soldering, or both.

A biasing member 58 is provided within the biasing member sleeve 56 and surrounds at least a portion of the indicator pin 46. The biasing member 58 may be of any suitable construction. In a preferred form, the biasing member 58 comprises a helical coil spring. In the illustrated embodiment, one end of the biasing member 58 rests on the a bottom of the sleeve 56, while the other end engages the enlarged head 54 of the pin 46. Due to energy stored by the biasing member 58, the indicator pin is urged outwardly from the fuse during activation of the indicator assembly 44. It should be noted that the enlarged end 48 of the indicator pin 46 is larger than the opening formed in the bottom of sleeve 56, thereby acting as a "stop" which prevents the indicator pin 46 from being entirely ejected from the fuse.

A protective shield 34 is disposed within the fuse so as to surround the entire indicator assembly 44. The protective shield 34 is best illustrated in FIGS. 3B and 4–6. Shield 34 can be formed of any suitable material, such as metal or plastic. In a preferred embodiment, the shield 34 is formed of a liquid crystal polymer. One such polymer is commercially known as XYDAR G930™ resin.

The shield 34 has a conically shaped end 36. The precise dimensions and shape of the shield 34 can vary widely. In one preferred form the conical end defines an included obtuse angle "θ" of approximately 120°. A small passage 37 is formed in the conical end. By way of example only, the diameter of the small passage D37 can be approximately 0.46 mm (0.018 inches).

The shield 34 has a generally cylindrical section or body 38, and a mounting flange 40 disposed at the end opposite from the conically shaped end 36. The mounting flange 40 includes a slot or passage 39 disposed therein, the purpose of which will be described below. The mounting flange 40 rests upon an end of the fuse body 16.

Shield 34 can enable fuses having a rating of 5 Amps or greater to function properly, even in the absence of an arc-quenching filler.

A main fuse link 22 electrically connects both terminals 18, 20. Main fuse link 22 has a first end 24 in contact with one terminal 18. Solder 26 may be introduced at terminal 18 to secure the main fuse link 22 and improve the electrical connection. The main fuse link 22 can have an angled transition area 28 extending from the first end 24. In a preferred embodiment, a "weak spot", such as an area of reduced dimensions 29 (see FIG. 7) is provided in this angled transition area 28. The "weak spot" is provided as a way of designating the location of the fuse that will be destroyed in the event that the fuse is "blown" or subjected to a current level above that which it is intended to carry. Preferably, the weak spot or area of reduced dimension 29 is longitudinally centered between the terminal 18 and the conical end 36 of the shield 34, thereby reducing the possibility that the main fuse link 22 will interfere with activation of the indicator assembly 44.

The main fuse link 22 extends from the angled transition section 28 between the exterior surface of the shield 34 and the interior surface of the fuse housing 16. This section 30 of the fuse link 22 can take any form necessary. In a preferred embodiment, section 30 is generally planar.

The main fuse link 22 terminates at a second end 32. The second end 32 passes through the slot 39 in the shield 34 and through a passage 64 formed in the mounting ledge 62 of terminal 20.

In the event that the shield 34 is formed from metal, it may not be necessary to bring the main fuse link 22 into direct contact with terminal 20. For example, terminal 20 would be electrically connected to shield 34 via metallic mounting flange 40. Therefore, the second end could be brought into contact with the shield alone to make the necessary electrical connection.

The main fuse link 22 can be formed from any suitable conductive material. By way of example only, the main fuse link 22 can be constructed of zinc. The fuse link 22 can be made from any suitable fusible material known to those of ordinary skill in the art.

Figure 8:
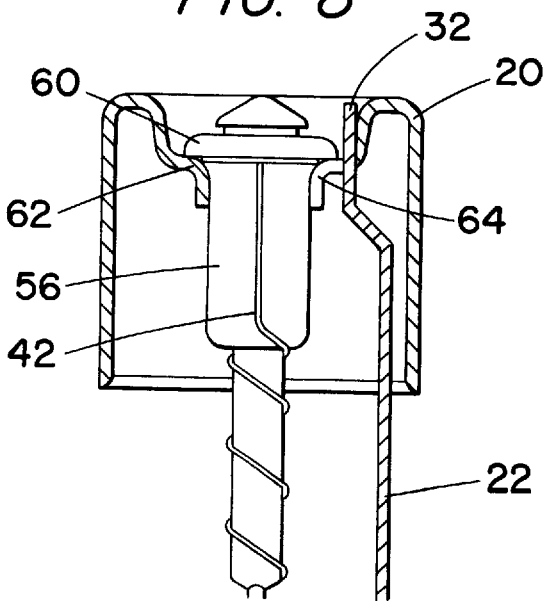
FIG. 8 is a partial view of FIG. 7 from a different perspective.

A conductor wire 42 is attached at one end to a terminal 18. The wire 42 can be attached to the terminal 18 by solder 26. Wire 42 passes through the passage 37 in the conically-shaped end 36 of the shield. The diameter of the passage 37 is slightly larger than the diameter of the wire. For example, the wire can pass through the passage 37 with a radial clearance of approximately 0.006 inches. The wire 42 is also attached to at least the enlarged flat end 48 of the indicator pin 46. The wire 42 may also be wrapped around arcuate notch 50 a few turns, then continue along indicator pin 46 in a helical manner. As illustrated in FIGS. 7 and 8, the wire 42 can also extend around the exterior of the bias member sleeve and under mounting flange 60. Therefore, the conductor wire is electrically connected to both terminals 18, 20. In the event of a current overload, at least a portion of the wire 42 between the terminal 18 and the flat end of the pin 48 is destroyed and the pin 46 is released. The helical windings of the wire 42 can collapse upon each other as the pin 46 is ejected thereby avoiding interference with pin 46 as it travels through the hole in the bottom of sleeve 56. The precise manner in which the conductor wire 42 is attached to the indicator assembly can vary so long as the requisite electrical connection between the terminals 18, 20 is achieved.

While intact, the conductor wire 42 restrains the indicator pin 46. The wire 42 is strong enough to prevent the biasing member 58 from urging the indicator pin 46 outward.

In certain lower amperage rated fuses, conductor wire 42 may also serve as the main fuse link, thereby enabling omission of a separate main fuse link element 22.

This fuse construction provides several advantages. The shield 34 isolates the indicator assembly 44 from the main fuse link 22 and helps close the end of the fuse from which the indicator pin 46 projects. Therefore, the electrical arcing and gases produced when the main fuse link 22 is destroyed can be adequately contained without resorting to the use of an arc-quenching filler. Consequently, the fuse of the present invention 10 is less costly to manufacture and more reliable in operation. Moreover, the location of the main fuse link 22 and its isolation from the indicator assembly 44 by shield 34 helps prevent interference with the activation of the indicator assembly upon destruction of the main fuse link 22.

Operation of the fuse of the present invention 10 will now be described.

During normal operating conditions, current is carried through the fuse 10 primarily via the main fuse link 22. During an overload situation, the main fuse link 22 is destroyed, preferably in the area of the "weak spot" or area of reduced dimensions 29. Current is then diverted to wire 42. Since the capacity of wire 42 to carry current is substantially less than that of the main fuse link 22, conductor wire 42 is quickly destroyed as well. At this point the wire 42 is no longer able to restrain the indicator pin 46, and the biasing member 58 is free to urge the indicator pin outwardly away from the fuse body 16. The indicator pin 46 is "stopped" from being totally ejected from the fuse by enlarged end 48 which cannot pass through the opening defined in the bottom of bias member sleeve 56.

Only preferred embodiments of the invention are specifically illustrated and described herein. It should be appreciated that numerous modifications and variations of the present invention are possible in light of the present disclosure, such modifications and variations being encompassed within the scope of the appended claims without departing from the spirit and scope of the present invention.

What is claimed is:

1. A fuse comprising:

a fuse body having a longitudinal axis;

terminal portions at opposite ends of said fuse body;

a main fuse link electrically connected to each of said terminal portions;

an indicator assembly, maid indicator assembly comprising an indicator pin having a first and second end opposite said first end, a bias member, and a bias member sleeve completely surrounding said bias member;

a conductor wire electrically connected to said terminal portions, and attached to said indicator assembly, whereby destruction of said conductor wire activates said indicator assembly thereby indicating a blown-fuse condition;

an insulative shield member separate from said fuse body and radially encompassing said indicator assembly, said shield extending longitudinally so as to longitudinally encompass said indicator assembly from a point near said first end of said indicator pin to at least a point at said second end of said indicator pin; and said fuse is essentially free of filler material.

2. The fuse of claim 1, wherein said fuse is rated for service at 5 Amps or more.

3. The fuse of claim 1, wherein said shield has a generally cylindrical body and has a first conically-shaped end portion.

4. The fuse of claim 3, wherein said shield has a second end opposite from said conically-shaped end, and a mounting flange disposed on said second end that rests upon an end of said fuse body.

5. The fuse of claim 1, wherein said shield is formed of a liquid crystal polymer.

6. The fuse of claim 3, wherein said conical end has a passage formed therein, and said conductor wire passes through said passage with a close clearance.

7. The fuse of claim 6, wherein said close clearance is no greater than approximately 0.006 inches.

8. The fuse of claim 1, wherein said conductor wire is attached to one of said terminal portions and to at least one of said first and second ends of the indicator pin in order to retain said indicator pin substantially within said fuse body while said fuse is in a normal operative condition.

9. The fuse of claim 1, wherein:

said indicator pin is centrally-located and has an enlarged head portion, said indicator pin being dimensioned such that at least said enlarged head portion extends beyond the fuse body upon activation of said indicator assembly;

said bias member sleeve surrounding said indicator pin and mounted to one of said terminal portions;

said bias member housed within said bias member sleeve and contacting said enlarged head portion to urge said indicator pin outwardly away from said fuse body upon activation of said indicator assembly; and said conductor wire is attached to one of said terminal portions and to an end of said indicator pin in order to retain said indicator pin substantially within said fuse body when said fuse is in a normal operative condition.

10. The fuse of claim 9, wherein:

one of said terminal portions comprises a ferrule, said ferrule having a mounting ledge disposed thereon; and said bias member sleeve includes a mounting flange that rests upon said mounting ledge.

11. The fuse of claim 1, wherein said main fuse link is located outside of said shield.

12. The fuse of claim 11, wherein said main fuse link has a section of reduced dimension, said section of reduced dimension being longitudinally centered between said conically-shaped end of said shield and one of said terminal portions.

13. The fuse of claim 1, wherein:

a first end of said main fuse link is soldered to one of said terminal portions;

said main fuse link having a first angled transition section extending from said first end that diverges away from said conductor wire in order to prevent contact and interference between said main fuse link and said conductor wire;

said main fuse link having a second generally planar section extending from said angled transition area and passing between an exterior surface of said shield and an interior surface of said fuse body; and said main fuse link extending through a slot formed in said shield and terminating at a second end that is in contact with the other of said terminal portions.

14. The fuse of claim 1, wherein said fuse includes an orientation ring attached to the outer periphery of said fuse body.

15. The fuse of claim 1, wherein said terminal portions are ferrules constructed from a material chosen from the group consisting of: silver-nickel alloy, albaloy-plated copper, copper alloy, and silver-plated copper.

16. The fuse of claim 1, wherein said conductor wire serves as said main fuse link.

17. A fuse comprising:

a fuse body having a longitudinal axis;

terminal portions at opposite ends of said fuse body;

an indicator assembly, said indicator assembly comprising an indicator pin having a first end an a second end opposite said first end, a bias member, and a bias member sleeve completely surrounding said bias member;

a conductor wire electrically connected to said terminal portions, and attached to said indicator assembly, whereby destruction of said conductor wire activates said indicator assembly thereby indicating a blown-fuse condition;

an insulative shield member separate from said fuse body and radially encompassing said indicator assembly, said shield extending longitudinally so as to longitudinally encompass said indicator assembly from a point near said first end of said indicator pin to at least a point at said second end of said indicator pin; and a main fuse link, a first end of said main fuse link is electrically connected to one of said terminal portions, said main fuse link having a first angled transition section extending from said first end that diverges away from said conductor wire in order to prevent contact and interference between said main fuse link and said conductor wire, said main fuse link having a second section extending from said angled transition area and passing between an exterior surface of said shield and an interior surface of said fuse body, and said main fuse link terminating at a second end that is electrically connected with the other of said terminal portions.

18. The fuse of claim 17, wherein said main fuse link has a section of reduced dimension, said section of reduced dimension being longitudinally centered between said conically-shaped end of said shield and one of said terminal portions.

19. The fuse of claim 17, wherein said shield has a generally cylindrical body and has a first conically-shaped end portion.

20. The fuse of claim 19, wherein said conical end has a passage formed therein, and said conductor wire passes through said passage with a close clearance.

21. The fuse of claim 19, wherein said shield has a second end opposite from said conically-shaped end with a mounting flange disposed on said second end that rests upon an end of said fuse body, a slot is formed in said second end of said shield, and said second end of main fuse link extending through said slot formed in said shield and contacts the other of said terminal portions.

* * * * *